United States Patent [19]

Kasuya et al.

[11] Patent Number: 4,671,751

[45] Date of Patent: Jun. 9, 1987

[54] SCREW ROTOR TOOTH PROFILE

[75] Inventors: Katsuhiko Kasuya; Shigeru Sasaki, both of Ibaraki; Toshiaki Nagai, Hadano, all of Japan

[73] Assignee: Hitachi, Ltd., Tokyo, Japan

[21] Appl. No.: 827,625

[22] Filed: Feb. 10, 1986

[30] Foreign Application Priority Data

Mar. 4, 1985 [JP] Japan ..... 60-41091

[51] Int. Cl.[4] ..... F04C 18/16

[52] U.S. Cl. ..... 418/201; 74/424.7

[58] Field of Search ..... 418/201, 150

[56] References Cited

U.S. PATENT DOCUMENTS 3,314,598 4/1969 Lysholm ..... 418/150
4,140,445 2/1979 Schibbye ..... 418/201
4,475,878 10/1984 Kasuya ..... 418/201
4,492,546 1/1985 Kasuya ..... 418/201

FOREIGN PATENT DOCUMENTS 53-39508 11/1978 Japan
59-37291 2/1984 Japan ..... 418/201

*Primary Examiner*—Carlton R. Croyle
*Assistant Examiner*—Jane E. Obee
*Attorney, Agent, or Firm*—Antonelli, Terry & Wands

[57] ABSTRACT

A screw rotor tooth profile which comprises a pair of male and female rotor tooth profiles engaging each other. The screw rotor tooth profile is configured such that at least one of the male and female rotor tooth profiles has a point of minimum pressure angle or an engaging tooth surface concurring with those of a theoretical tooth profile and is deviated from the theoretical tooth profile such that the amount of deviation increases as going from the point of minimum pressure angle or the engaging tooth surface toward the tooth top side and the tooth bottom side. The screw rotor tooth profile, even in case of the presence of machining and/or assembling errors in the profiles, are capable of assuring excellent mutual tooth engagement therebetween and almost not susceptible to that or those errors, that is, insensitive to manufacturing precision.

9 Claims, 5 Drawing Figures

SCREW ROTOR TOOTH PROFILE

BACKGROUND OF THE INVENTION

The present invention relates to relatively large diameter screw rotor tooth profiles for hydraulic systems such as, for example, screw compressors, expanding machines or the like and, more particularly, to screw rotor tooth profiles which can hardly be influenced by machining and/or assembling errors, etc. thereof, that is, which have an insensitivity to manufacturing precision thereof.

Generally, in the field of screw rotor tooth profiles, a pair of male and female rotor tooth profiles engaging each other with no clearance provided therebetween are referred to as theoretical tooth profiles.

A pair of rotor tooth profiles with theoretical tooth profiles, however, fail to provide smooth rotational movements because they tend to be subjected to influences of machining and/or assembling errors in the tooth profiles, thermal expansion during their operation, etc.

In for example, Japanese Patent Unexamined Publication No. 39508-53, it has been proposed to modify the rotor tooth profiles in such a manner that the male or female rotor tooth profile thereof has a trailing flank deviated in a direction causing reduction in its dimension relative to that of the theoretical tooth profile thereof, so that a clearance may be defined between a pair of rotor tooth profiles to obtain a smooth rotation during operation. In the case of large diameter rotors of, for example, 200 mm or more, the hob milling process is difficult because of technological limitations in the manufacture of proper tools thereof, so that the rotors are manufactured by a single cutter. However, such tooth cutting process is often accompanied by large machining errors. More particularly, in the single cutter machining, the rotor grooves are usually cut one by one and therefore, the working conditions differ, so that errors arise in the indexing precision becomes. Besides, the manufacturing of high precision tools is relatively difficult.

The above-mentioned modified type of rotor tooth profiles however, are disadvantageous in that it becomes difficult to maintain a proper tooth engagement on the leading flanks of the male and female rotor tooth profiles due to machining errors or errors of distance between the shafts during an assembly of the system. As is known, the best force transmitting tooth surface (engaging tooth surface) on the leading flank is found at or near a point of minimum pressure angle. However, in case where the distance between the shafts is shorter than its prescribed distance due to the errors during the manufacturing, the bottom part of the tooth of the female rotor contacts the top part of the tooth of the male rotor. On the contrary, in case where the actual distance between the shafts is longer than the prescribed distance, the part of the tooth of the female rotor existing on the top side beyond the point of minimum pressure angle contact the part of the tooth of the male rotor existing on the bottom side away from the point of minimum pressure angle. Thus, in either case of the above errors, it is difficult for the engaging tooth surfaces of the leading flanks obtain a proper tooth engagement at or near the point of minimum pressure angle. The afore-mentioned modified type of screw rotor tooth profiles, thus, has a problem of which the rotors sensitively suffer influences of manufacturing errors.

In, for example, U.S. Pat. No. 4,140,445, another type of rotor tooth profile is proposed wherein the leading and trailing flanks of the female rotor are modified to deviate in a direction diminishing dimensions thereof relative to those of the theoretical tooth profiles.

Since, in the above-described proposed rotor tooth profiles, the amount of the deviation near the pitch circle of the tooth flanks is small, these rotor tooth profiles cause no particular problem as long as they are manufactured exactly according to the theoretical tooth profiles thereof or they have no errors noted above.

In case where the clearance between both rotor tooth profiles has rendered extremely narrow due to influences of manufacturing or assembly errors or the like, however, a proper tooth engagement at engaging tooth surfaces can not be obtained and, in the worst case, there is a possibility that a pair of rotor tooth profiles completely fail to engage each other profiles.

SUMMARY OF THE INVENTION

Accordingly, the present invention aims to provide screw rotor tooth profiles which are almost not susceptible to machining and/or assembling errors etc. of the rotor tooth profiles, that is, having an insensitivity to manufacturing precision.

Further, the present invention aims to provide screw rotor tooth profiles which assure an optimum tooth engagement even in case that various errors noted above should occur in the machining and/or assembling etc.

To this end, according to the invention, there are provided screw rotor tooth profile comprising a pair of engageable male and female rotor tooth profiles rotatable around a pair of parallel shafts, with tooth profiles having leading and trailing flanks. At least one of the male and female rotor tooth profiles has a point of minimum pressure angle or an engaging tooth surface concurring with those of a theoretical tooth profile and is deviated from the theoretical tooth profile thereof such that the amount of deviation increases as going from the point of minimum pressure angle or the engaging tooth surface toward the tooth top side and the tooth bottom side.

DETAILED DESCRIPTION

Figure 1:
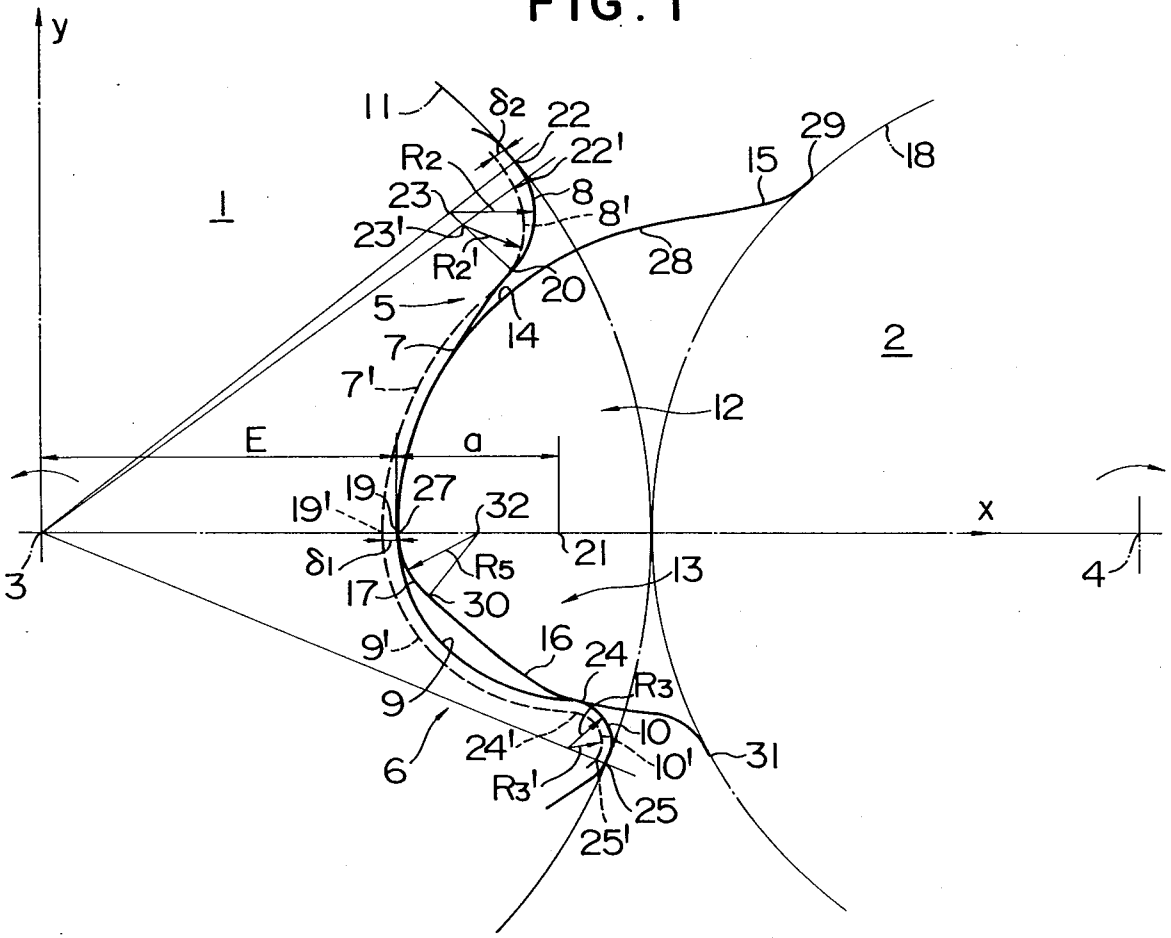
FIG. 1 is a view taken along a plane perpendicular to rotor shafts, of a pair of screw rotor tooth profiles according to the invention, illustrating one embodiment in which a deviation is provided at the leading flank of a female rotor tooth profile with reference to a minimum pressure angle of the female rotor.

Referring now to the drawings wherein like reference numerals are used throughout the various views to designate like parts and, more particularly to FIG. 1, according to this figure, a pair of screw rotor tooth profiles according to the present invention are illustrated with the solid lines depicting theoretical tooth profiles comprising a female rotor tooth profile 1 and a male rotor tooth profile 2 which engage each other with no clearance provided therebetween and rotate around respective shafts arranged in parallel.

Figure 2:
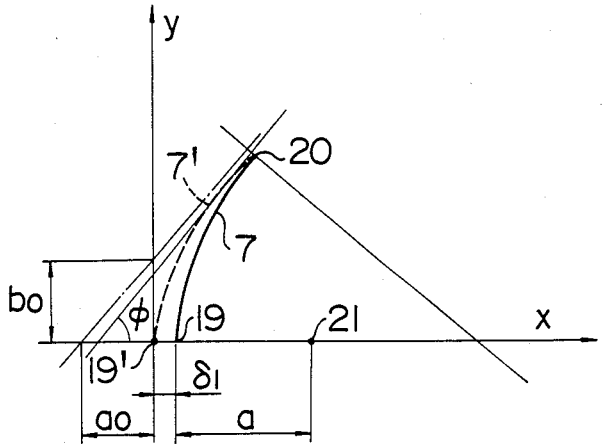
FIG. 2 is a graphical illustration of how a tooth profile curve is determined at a screw rotor tooth profile according to the present invention.

In FIGS. 1 and 2, the female rotor tooth profile 1 and a male rotor tooth profile 2 are shown on a plane perpendicular to rotating axes of rotors. The female rotor is driven by the male rotor. The rotor tooth profiles 1 and 2 are arranged to rotate respectively around center points 3 and 4 within a casing (not shown) so as to function as a compressor.

The female rotor tooth profile 1 comprises, as its main parts, a leading flank 5 composed of a first leading flank 7 and second leading flank 8 and a trailing flank 6 composed of a first trailing flank 9 and second trailing flank 10. These main parts are located inside a pitch circle 11.

On the other hand, the male rotor tooth profile 2 comprises, as its main parts, a leading flank 12 composed of a first leading flank 14 and second leading flank 15 and a trailing flank 13 composed of a first trailing flank 17 and second trailing flank 16. These main parts are located outside a pitch circle 18.

The first leading flank 7 of the female rotor tooth profile 1 is formed between points 19 and 20. The form of the first leading flank 7 between the points 19 and 20 is defined by a parabolic curve which is expressed by an equation $Y^2=4a\ (X-E)$, where, in a rectangular coordinate system of axes X, Y with its origin located at the rotary shaft center point 3, E represents the distance between the center point 3 and the point 19 and a represents the distance between the point 19 and a focal point 21 inside the pitch circle 11 on a line connecting the rotary shaft center points 3 and 4.

On the other hand, the second leading flank 8, defined between the points 20 and 22, is formed by an arc of a circle having radius $R_2$ with its center located at a point 23 inside the pitch circle 11 and the first trailing flank 9, defined between the points 19 and 24, is created by an arc of a circle having radius $R_5$ of the first trailing flank 17 of the male rotor 2. The second leading flank 10, defined between points 24 and 25, is formed by an arc of a circle having radius $R_3$ with its center located at a point 26 inside the pitch circle 11.

The form of its first leading flank 14, defined between points 27 and 28, is created by the parabola of the first leading flank (between the points 19 and 20) of the female rotor tooth profile 1. The forms of the second leading flank 15, defined between the points 28 and 29, and the second trailing flank 16, defined between points 30 and 31, are created respectively by the arc of the circle with the radius $R_2$ of the second leading flank 8 (between the points 20 and 22) of the female rotor tooth profile 1 and by the arc of the circle with the radius $R_3$ of said second trailing flank 10 (between the points 24 and 25) of the female rotor tooth profile 1. The form of the first trailing flank 17 between the points 27 and 30 is provided by an arc of a circle having radius $R_5$ with its center located at a point 32 on a line connecting the rotary shaft center points 3 and 4 of the female and male rotor tooth profiles 1 and 2.

In both the rotor tooth profiles 1 and 2 (shown by the solid lines and referred to as the theoretical profiles) respectively configured as explained above, the first leading flank 5 of the female rotor tooth profile 1 has its point of minimum pressure angle (approximately 30°) disposed at a point 20 connecting the first leading flank 7 to the second leading flank 8, while the first leading flank 12 of the male rotor tooth profile 2 has its point of minimum pressure angle disposed at a point 28 connecting the first leading flank 14 to the second leading flank 15. It has been found that, at the time of transmitting a rotating force from the male rotor tooth profile 2 to the female rotor tooth profile 1, the most efficient transmission of the force is obtained when tooth engagement is conducted by the tooth surfaces on the opposing leading flanks at or near the point of minimum pressure angle as already described and it is not preferable to have tooth surfaces other than those concerned in the transmitting of the force by reason of mechanical loss as will be explained more fully hereinbelow.

Figure 3:
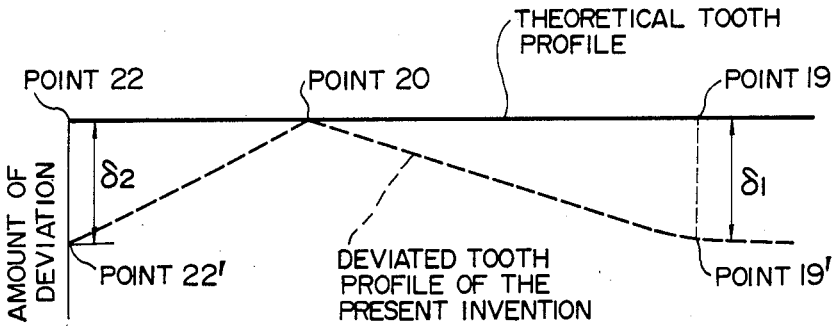
FIG. 3 is schematic enlarged development of the female rotor tooth profile shown in FIG. 1, illustrating its deviated state.
Figure 4:
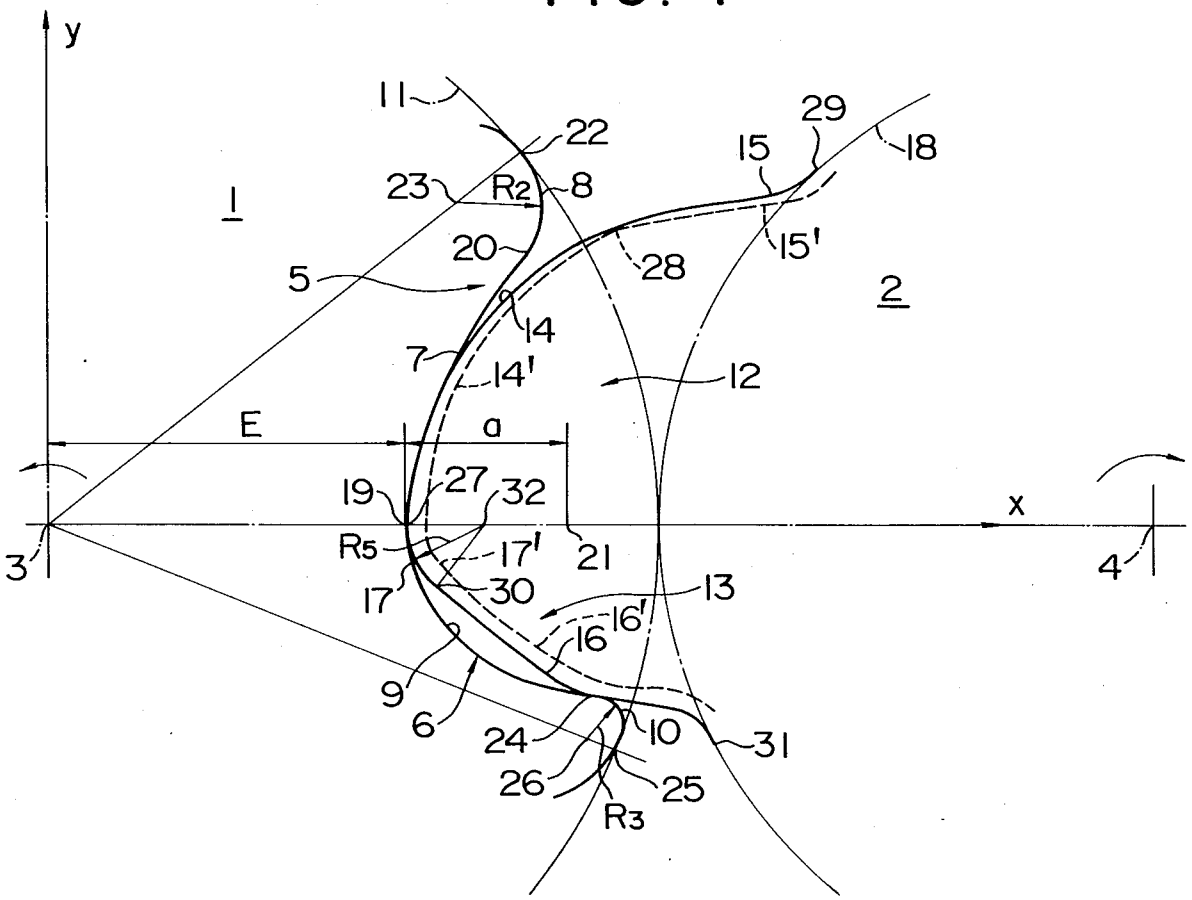
FIG. 4 is a view taken along a plane perpendicular to rotor shafts, of a pair of screw rotor tooth profiles according to the present invention, illustrating another embodiment in which a deviation is provided at the leading flank of a male rotor tooth profile with reference to a minimum pressure angle of the male rotor.

For instance, when a deviation is given to the female rotor tooth profile alone, the point 20 of minimum pressure angle on the first leading flank 5 of the female rotor tooth profile 1, as shown in FIGS. 1 through 3, is located on the theoretical tooth profile indicated by the solid line and, as preceeding from the point 20 toward the top side and bottom side of the tooth, the deviation is continuously increased as illustrated by a dotted line. That is, the deviation from the theoretical profile is given in a direction causing tooth thickness to diminish. The modified form of the female rotor tooth profile 1 is defined as follows. Reference numeral 8' indicates the second leading flank deviated from the second leading flank 8 of the theoretical tooth profile shown by the solid line. The second leading flank 8' is defined between the points 20 and 22' and formed by an arc of a circle having radius $R_2'$ with its center located at a point 23' on a line connecting the point of minimum pressure angle 20 and the center 23 of the radius $R_2$. The tip point 22' of the tooth indicates a point of intersection of an arc of the radius $R_2'$ with an extension of a line connecting the rotation center 3 of the female tooth profile 1 to the center point 23' of the circular arc. Here, it is determined that the amount of deviation between the radii $R_2$ and $R_2'$ is $\delta_2$ (0.1−0.15 mm) and the radius $R_2'$ equals to the value $R_2-\delta_2$.

On the other hand, the first leading flank 7' deviated from the first leading flank 7, of the theoretical tooth profile, is formed by a hyperbola extending through a point 19' inwardly deviated by $\delta_1$ (0.1−0.15 mm) from the lowest tooth bottom of the theoretical tooth profile and the point of minimum pressure angle 20. The amount of the deviation continuously increases as the deviation proceeds from the point 20 toward the point 19' of the tooth bottom. The reason for using the hyperbola on the first leading flank of the modified tooth profile instead of the parabola forming that of the theoretical tooth profile resides in the fact that the normal line at the point 20 of the first leading flank 7 of the theoretical tooth profile can be the same as the normal line at the point 20 of the deviated first leading flank 7'; that is, both the first leading flanks can have a common normal line. Additionally, by forming the first leading flank 7' with the hyperbola and the second leading flank 8' with the circular arc respectively, the amount of the deviation from the theoretical tooth profile can continuously increase as the deviation proceeds from the point of minimum pressure angle 20 toward the tooth top and the tooth bottom thereof. Thus, by the transmitting of rotative force at the point of minimum pressure angle 20 where the hyperbola is connected to the circular arc, the forces acting in the normal line direction and the radial direction can be diminished to thereby make it possible to reduce mechanical loss and also extend the life-time of bearings which support the rotor. Especially, in oil-cooled screw compressors, because the transmission torque between tooth surfaces is rather small, it is sufficient only to ensure the narrow tooth engagement at or near the point of minimum pressure angle.

The trailing flank 6 connected to the leading flank 5 is formed by a first trailing flank 9' and a second trailing flank 10' which are deviated in the normal line direction by a constant amount identical to that of the deviation $\delta_1$ of the first leading flank 7'. More particularly, the first trailing flank 9' between the points 19' and 24' is deviated from the first trailing flank 9 of the theoretical tooth profile, shown by the solid line, by the amount $\delta_1$ in the tooth thickness decreasing direction. And, the second trailing flank 10' between the points 24' and 25' is formed by an arc of a circle with radius $R_3'$ having its center located at a point 26. Here, it is determined that the value of the radius $R_3'$ equals to $R_3-\delta_1$.

Of note, said amounts of the deviation $\delta_1$ and $\delta_2$ may be identical or different.

When the parabola forming the first leading flank 7 of the theoretical tooth profile and the amount of the deviation $\delta_1$ are given, the hyperbola forming the first leading flank 7' is obtained as follows.

In FIG. 2, the parabola forming the first leading flank 7 is expressed by an equation (1):

$$Y^2=4\cdot a\,(X-\delta_1) \tag{1}$$

And, the hyperbola forming the deviated first leading flank 7' is expressed by an equation (2):

$$\frac{(x+a_0)^2}{a_0^2}-\frac{y^2}{b_0^2}=1 \tag{2}$$

Since two normal lines at the point 20 of minimum pressure angle on the those two kinds of curves must agree with each other, in other words, the gradients of the tangent lines at the point 20 thereof must agree with each other, from the equation (1), $$\frac{dy}{dx}=\frac{a}{\sqrt{a(x-\delta_1)}}=\tan\phi \tag{3}$$

and from the equation (2), $$\frac{dy}{dx}=\frac{b_0^2\,(x+a_0)}{a_0^2\cdot y} \tag{4}$$

The equation (3)=the equation (4), then $$a_0=\frac{x\cdot y-\tan\phi\cdot x^2}{2\tan\phi\cdot x-y} \tag{5}$$

and,

-continued $$b_0=\frac{a_0^2\cdot y\cdot\tan\phi}{x+a_0} \tag{6}$$

Thus, constituent dimensions for the hyperbola are obtained from the x and y coordinate values at the point 20 and the value of $\phi$.

On the leading flank 12 of the male rotor tooth profile 2, a point of minimum pressure angle 28 is located on the theoretical tooth profile shown by a solid line.

Reference numeral 14' indicates a first leading flank deviated from the first leading flank 14 of the theoretical tooth profile shown by the solid line to the tooth thickness decreasing direction. The amount of this deviation on the first leading flank 14' continuously increases from the point 28 of minimum pressure angle. And, numeral 15' indicates a second leading flank deviated from the second leading flank 15 of the theoretical tooth profile shown by the solid line to the tooth thickness decreasing direction. The amount of deviation on said second leading flank 15' continuously increases from the point 28 of minimum pressure angle, and further a first and second trailing flanks 17' and 16' are given a constant amount of deviation. Although not shown in the drawing, it is possible, if desired, to select the point of minimum pressure angle on the trailing flank 13 of the theoretical tooth profile.

Figure 5:
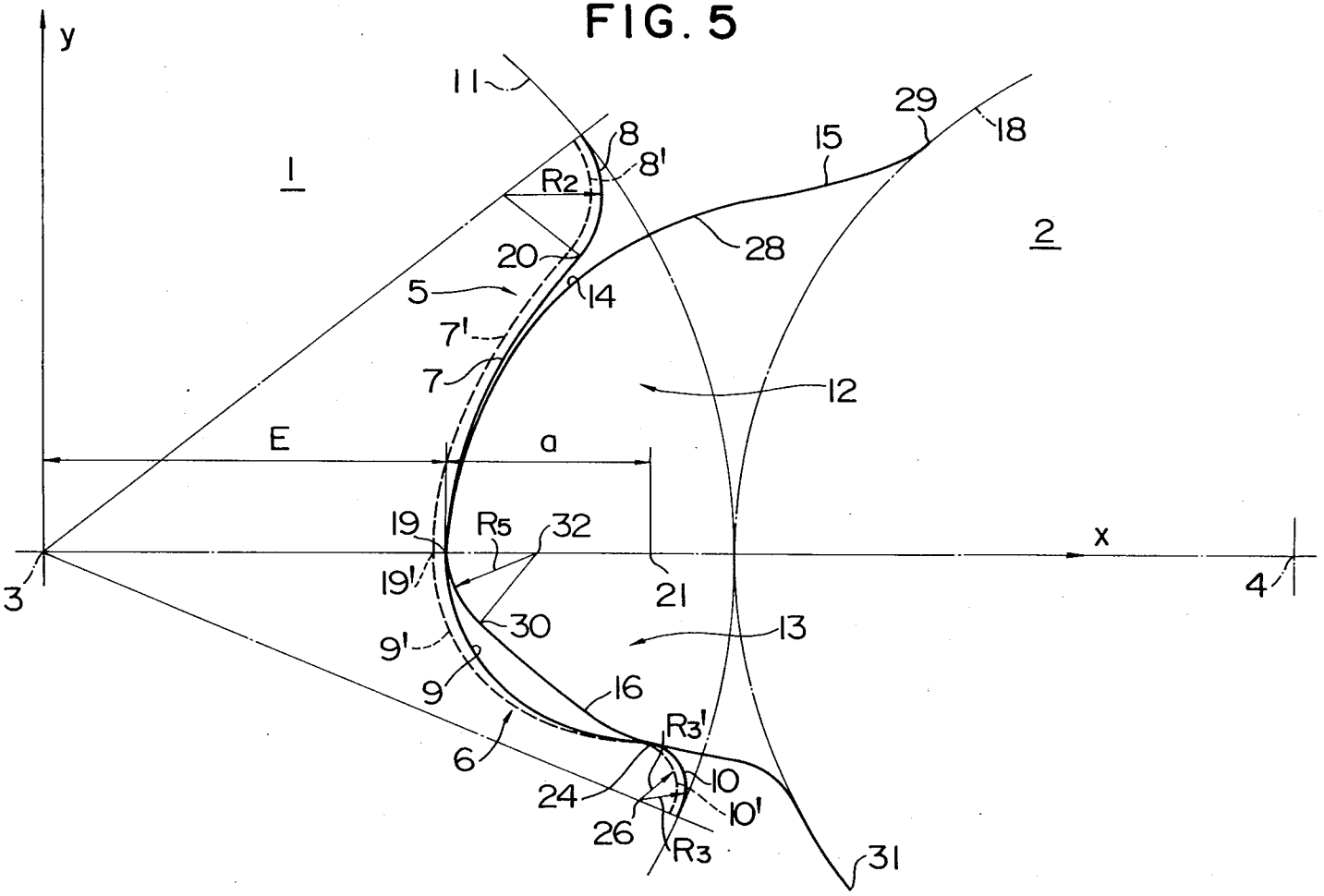
FIG. 5 is a view taken along a plane perpendicular to rotor shafts, of a pair of screw rotor tooth profiles according to the present invention, illustrating another embodiment in which a deviation is provided at the trailing flank of a female rotor tooth profile with reference to a minumum pressure angle of the female rotor.

In FIG. 5, on the trailing flank 6 of the female rotor tooth profile 1, the point 24 of minimum pressure angle (about 15°) is located on the theoretical tooth profile shown by a solid line.

Numeral 9' indicates a first trailing flank deviated from the first trailing flank 9 of the theoretical tooth profile to the same direction as those already mentioned in the previous drawings and the amount of deviation on the first leading flank 9' also continuously increases from the point of minimum pressure angle 24.

Numeral 10' indicates a second trailing flank deviated from the second trailing flank 10 and the amount of deviation on the second following flank 10' also continuously increases from the point of minimum pressure angle 24.

As will be understood from the foregoing description, by forming the leading and trailing flanks of the female rotor tooth profile 1 or the leading flank of the male rotor tooth profile 2 such that the amount of deviation thereof from the theoretical tooth profiles continuously increase as going from the respective points of minimum pressure angles toward the tooth top direction and the tooth bottom direction as well, a pair of screw rotor tooth profiles can be obtained which are almost not susceptible to machining and/or assembling errors, etc. involved in the rotor tooth profiles, that is, which have an insensitivity to manufacturing precision thereof.

In other words, even in case of the presence of various errors it is possible to have tooth engagement in a narrow area at or close to a point of minimum pressure angle which assuredly carries out the transmission of rotative torque.

Further, in case of rotor diameter being large, the single cutter is used for tooth cutting because the manufacture of hob for tooth cutting tool is difficult, but such cutting cannot cause precise cutting. The modified rotor tooth profiles according to the present invention, however, make it possible to provide excellent tooth engagement required for force transmission even in case of the errors of cutting being large. Accordingly, the modified tooth profiles are very effective when applied to a large-sized screw compressor adopting large diameter rotor tooth profiles. Besides, said effect of the invention can also be provided by using the aforedescribed modified type of rotor tooth profiles in job cutting operations or the like where there is a possibility of occurrence of large errors.

Although, in the disclosed embodiments of the invention, explanation has been made with respect to the cases in which the point of minimum pressure angle coincides with the engaging tooth surface position (the driving force position), as apparent, such coincidence with the point of minimum pressure angle is not necessarily required as long as the tooth engaging position is set on the theoretical tooth profile.

Further, while in the embodiments described above, the cases of giving deviation only to one of the female and male rotor tooth profiles have been described, it is to be understood that both of the rotor tooth profiles may be given deviations respectively if desired.

Besides, although, in one embodiment, a parabola has been adopted on the first leading flank of the theoretical tooth profile, it is also possible to use a circular arc or other curvilinear lines: that is, in the application of the present invention, the theoretical profile undergoes no particular limitation as regards the configuration thereof.

As noted above, according to the invention screw rotor tooth profiles, at least one of the female and male rotor tooth profiles constructed as a pair of theoretical tooth profiles engaging each other with no clearance provided therebetween has a point of minimum pressure angle or an engaging tooth surface selected on the theoretical tooth profile to thereby obtain tooth engagement required for force transmission only at or close to said point of minimum pressure angle or an engaging tooth surface position, so that a pair of screw rotor tooth profiles can be provided which can hardly be influenced by machining and/or assembling errors, etc., that is, which have an insensitivity to manufacturing precision thereof.

What is claimed is:

1. Screw rotor tooth profile comprising a pair of engageable male and female rotor tooth profiles rotatable around a pair of parallel shafts, said tooth profiles having leading and trailing flanks at least one of said male and female rotor tooth profiles has an engaging tooth surface concurring with that of a theoretical tooth profile and tooth surfaces other than said engaging surface are deviated from the theoretical tooth profile such that the amount of deviation is increased from said engaging surface to a tooth top side and a tooth bottom side.

2. Screw rotor tooth profile as defined in claim 1, wherein said engaging tooth surface determined on the theoretical tooth profile is a point of minimum pressure angle.

3. Screw rotor tooth profile as defined in claim 2, wherein said point of minimum pressure angle is determined on the leading flank of the theoretical tooth profile of the female rotor tooth profile and the amount of a deviation increases as going from said point of minimum pressure angle toward tooth top side and the tooth bottom side.

4. Screw rotor tooth profile as defined in claim 3, wherein the trailing flank connected to said leading flank is deviated from the theoretical tooth profile thereof such that the amount of the deviation is constant with respect to the direction of the normal line of said trailing flank.

5. Screw rotor tooth profile comprising a pair of engageable male and female rotor tooth profiles rotatable around a pair of parallel shafts, said tooth profiles having leading and trailing flanks characterized in that at least one of said male and female rotor tooth profiles has a point of minimum pressure angle concurring with a point of a theoretical tooth profile and is deviated from the theoretical tooth profile thereof such that an amount of deviation increases from the point of minimum pressure angle toward a tooth top side and a tooth bottom side.

6. Screw rotor tooth profile as defined in claim 1, wherein said point of minimum pressure angle is determined on the trailing flank of the theoretical tooth profile of the female rotor tooth profile and the amount of the deviation increases from said point of minimum pressure angle toward a tooth top side and a tooth bottom side.

7. Screw rotor tooth profile as defined in claim 1, wherein said point of minimum pressure angle is determined on the leading flank of the theoretical tooth profile of the female tooth profile and the amount of the deviation increases from said point of minimum pressure angle toward a tooth top side and a tooth bottom side.

8. Screw rotor tooth profile as defined in claim 7, wherein the trailing flank connected to said leading flank is deviated from the theoretical tooth profile thereof such that the amount of the deviation is constant with respect to a direction of the normal line of said trailing flank.

9. Screw rotor tooth profile as defined in claim 7, wherein said leading flank of the female rotor tooth profile comprises a first leading flank which is formed by a hyperbola extending through a point deviated from the lowest tooth bottom point of said theoretical tooth profile in the direction of the normal line and said point of minimum pressure angle and a second leading flank which is formed by an arc of a circle with its radius center positioned inside a pitch circle of the female rotor tooth profile.

* * * * *